US011227530B2

(12) United States Patent
Zhang

(10) Patent No.: US 11,227,530 B2
(45) Date of Patent: Jan. 18, 2022

(54) DISPLAY PANEL

(71) Applicant: SHENZHEN CHINA STAR OPTOELECTRONICS SEMICONDUCTOR DISPLAY TECHNOLOGY CO., LTD., Shenzhen (CN)

(72) Inventor: Xianming Zhang, Shenzhen (CN)

( * ) Notice: Subject to any disclaimer, the term of this patent is extended or adjusted under 35 U.S.C. 154(b) by 166 days.

(21) Appl. No.: 16/627,365

(22) PCT Filed: Dec. 17, 2019

(86) PCT No.: PCT/CN2019/125931

§ 371 (c)(1),
(2) Date: Dec. 30, 2019

(87) PCT Pub. No.: WO2021/109239

PCT Pub. Date: Jun. 10, 2021

(65) Prior Publication Data

US 2021/0343225 A1 Nov. 4, 2021

(30) Foreign Application Priority Data

Dec. 6, 2019 (CN) ..... 201911242011.X

(51) Int. Cl.
*G09G 3/20* (2006.01)

(52) U.S. Cl.
CPC ... *G09G 3/2092* (2013.01); *G09G 2310/0291* (2013.01); *G09G 2330/02* (2013.01)

(58) Field of Classification Search
CPC ..... G09G 3/2092; G09G 2310/0291; G09G 2330/02
See application file for complete search history.

(56) References Cited

U.S. PATENT DOCUMENTS

| | | | | |
|---|---|---|---|---|
| 2013/0106676 | A1 | 5/2013 | Ono et al. | |
| 2013/0162622 | A1 | 6/2013 | Ebisuno et al. | |
| 2015/0035813 | A1* | 2/2015 | Lei | H03F 3/393 345/205 |
| 2016/0335976 | A1 | 11/2016 | Chen et al. | |
| 2017/0186354 | A1 | 6/2017 | Zhang et al. | |

FOREIGN PATENT DOCUMENTS

| | | | |
|---|---|---|---|
| CN | 102834858 | A | 12/2012 |
| CN | 103038809 | A | 4/2013 |
| CN | 104299593 | A | 1/2015 |
| CN | 105099189 | A | 11/2015 |
| CN | 109637457 | A | 4/2019 |
| JP | 3384375 | B2 | 3/2003 |
| KR | 100530373 | B1 | 11/2005 |

* cited by examiner

*Primary Examiner* — Andrew Sasinowski

(57) ABSTRACT

The present application discloses a display panel, including a display body and a plurality of driving modules including a driving unit electrically connected to the display body; wherein at least a part of the driving modules further includes a voltage conversion unit, an input terminal of the voltage conversion unit is connected to a high-potential power supply voltage, and an output terminal of the voltage conversion unit is electrically connected to an input terminal of the driving unit to provide a preset driving voltage for the driving unit.

16 Claims, 3 Drawing Sheets

DISPLAY PANEL

FIELD OF INVENTION

The present application relates to the field of display technology, and in particular, to a display panel.

BACKGROUND OF INVENTION

At present, display panels are becoming increasingly larger, and XB (XC-Board, drive conversion board) is becoming increasingly longer. For a supply voltage VDD of source driver IC, each driver IC needs the supply voltage VDD. However, as panel size and resolution increase, more flip-chip films (COFs) need to be set. Due to voltage drop of wiring, a voltage value of the power supply voltage VDD of the driver IC on the COF away from a power connector is much smaller than a preset voltage value, which causes the driver IC to fail to work normally.

TECHNICAL PROBLEM

An embodiment of the present application provides a display panel to solve the technical problem that due to voltage drop of wiring, a voltage value of the power supply voltage VDD of the driver IC on the flip-chip film (COF) away from a power connector is much smaller than a preset voltage value, thereby causing the driver IC to fail to work normally.

SUMMARY OF INVENTION

In a first aspect, an embodiment of the present application provides a display panel, the display panel includes: a display body; a plurality of driving modules including a driving unit electrically connected to the display body, and the driving unit is configured to provide data driving signal for the display body; wherein, at least a part of the driving modules further includes a voltage conversion unit, an input terminal of the voltage conversion unit is connected to a high-potential power supply voltage, and an output terminal of the voltage conversion unit is electrically connected to an input terminal of the driving unit to provide a preset driving voltage for the driving unit; each of the driving modules disposed adjacent to corners of the display body includes the voltage conversion unit; and a voltage value of the high-potential power supply voltage connected to the input terminal of the voltage conversion unit greater than or equal to 1.8 volts.

In some embodiments, the first voltage division unit includes a first resistor, a first terminal of the first resistor is connected to a high-potential power supply voltage, and a second terminal of the first resistor is electrically connected to the first node.

In some embodiments, the second voltage division unit includes a second resistor, a first terminal of the second resistor is electrically connected to the first node, a second terminal of the second resistor is electrically connected to the second node, and a resistance value of the second resistor is greater than a resistance value of the first resistor.

In some embodiments, the resistance of the second resistor is 1.5 to 3 times the resistance of the first resistor.

In some embodiments, the voltage adjustment unit includes an amplifier, a non-inverting input terminal of the amplifier is connected to the reference voltage, an inverting input terminal of the amplifier is electrically connected to the first node, and an output terminal of the amplifier is electrically connected to the second node.

In some embodiments, a plurality of the driving modules positioned at a side of the display body and arranged at intervals along a longitudinal direction of the side of the display body.

In some embodiments, all the driving modules include the voltage conversion unit.

In a second aspect, the present application further provides a display panel, the display panel includes: a display body; a plurality of driving modules including a driving unit electrically connected to the display body, and the driving unit configured to provide data driving signal for the display body; wherein, at least a part of the driving modules further includes a voltage conversion unit, an input terminal of the voltage conversion unit is connected to a high-potential power supply voltage, and an output terminal of the voltage conversion unit is electrically connected to an input terminal of the driving unit to provide a preset driving voltage for the driving unit.

In some embodiments, the voltage conversion unit includes a first voltage division unit, a second voltage division unit, and a voltage adjustment unit.

Wherein a first terminal of the first voltage division unit is connected to a high-potential power supply voltage, a second terminal of the first voltage division unit, a first terminal of the second voltage division unit, and a first input terminal of the voltage adjustment unit are electrically connected to a first node.

Wherein a second input terminal of the voltage adjustment unit is connected to a reference voltage, such that a voltage value of the first node reaches a voltage value of the reference voltage; and an output terminal of the voltage adjustment unit, and an input terminal of the driving unit, and a second terminal of the second voltage division unit are electrically connected to a second node, such that a voltage value of the driving voltage output by the voltage adjustment unit reaches a preset value.

In some embodiments, the first voltage division unit includes a first resistor, a first terminal of the first resistor is connected to a high-potential power supply voltage, and a second terminal of the first resistor is electrically connected to the first node.

In some embodiments, the second voltage division unit includes a second resistor, a first terminal of the second resistor is electrically connected to the first node, a second terminal of the second resistor is electrically connected to the second node, and a resistance value of the second resistor is greater than a resistance value of the first resistor.

In some embodiments, the resistance value of the second resistor is 1.5 to 3 times the resistance value of the first resistor.

In some embodiments, the voltage adjustment unit includes an amplifier, a non-inverting input terminal of the amplifier is connected to the reference voltage, an inverting input terminal of the amplifier is electrically connected to the first node, and an output terminal of the amplifier is electrically connected to the second node.

In some embodiments, the plurality of the driving modules are positioned at a side of the display body and arranged at intervals along a longitudinal direction of the side of the display body.

In some embodiments, each of the driving modules disposed adjacent to the corners of the display body includes the voltage conversion unit.

In some embodiments, each of the driving modules includes the voltage conversion unit.

In some embodiments, a voltage value of the high-potential power supply voltage connected to the input terminal of the voltage conversion unit is greater than or equal to 1.8 volts.

BENEFICIAL EFFECT

A high-potential power supply voltage is provided to the driving module away from the power supply, and the voltage conversion unit is used to convert the high-potential power supply voltage input to the voltage conversion unit into a preset driving voltage, so that the driving voltage of the driving unit reaches a preset value. Therefore, failure of the driving unit to work normally due to driving voltage value of the driving unit being far smaller than the preset voltage value is prevented. At the same time, the voltage conversion unit can provide a more stable driving voltage for the driving unit, improve the display quality, and eliminate the need to add additional buck converters and voltage stabilizers outside the driving module to save costs.

DESCRIPTION OF DRAWINGS

In order to more clearly illustrate the technical solutions in the embodiments of the present invention, the following figures described in the embodiments will be briefly introduced. It is obvious that the drawings described below are merely some embodiments of the present invention, other drawings can also be obtained by the person ordinary skilled in the field based on these drawings without doing any creative activity.

REFERENCE NUMERALS

10: display body; 20: driving module; 21: driving unit; 22: voltage conversion unit; 221: first voltage division unit; 222: second voltage division unit; 223: voltage adjustment unit; 23: first module; 24: second module; 30: power supply.

DETAILED DESCRIPTION OF PREFERRED EMBODIMENTS

The present application provides a display panel. In order to make the purpose, technical solution, and effect of the present application clearer and more definite, the present application is further described in detail below with reference to the accompanying drawings and embodiments. It should be understood that the specific embodiments described herein are only used to explain the application, and are not used to limit the application.

The present invention is for a technical problem that current display panels, due to voltage drop of wiring, a voltage value of a power supply voltage VDD of a driver IC on a flip-chip film (COF) disposed away from a power connector is far smaller than a preset voltage value, which causes the driver IC to fail to work normally. The present invention can solve this technical problem.

Figure 1:
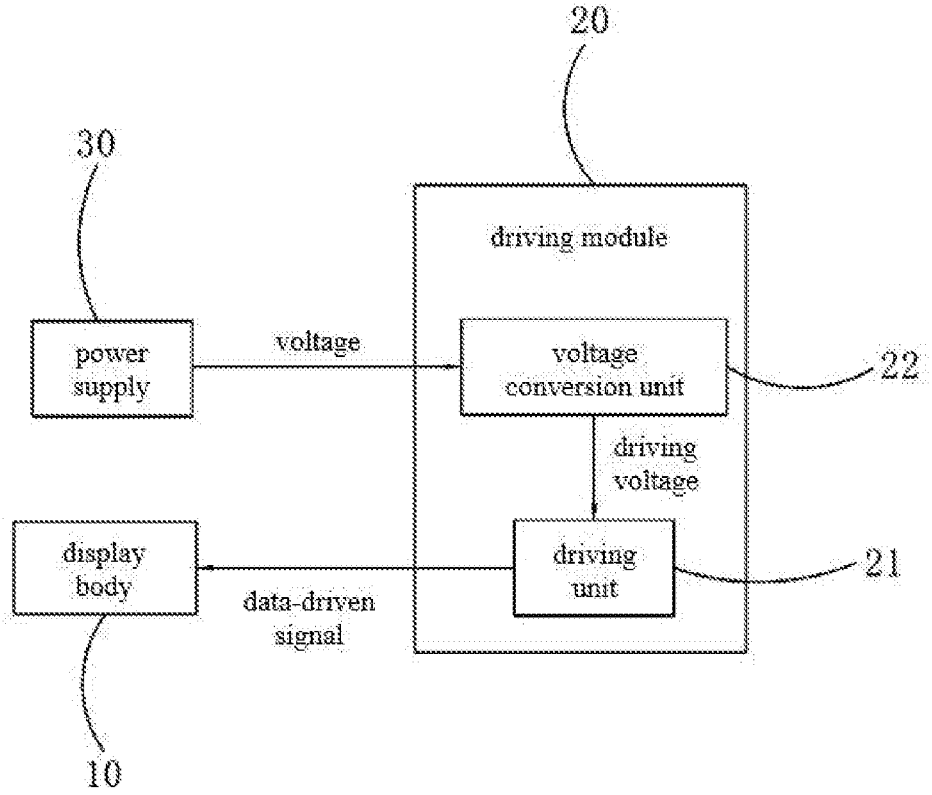
FIG. 1 is a schematic diagram of a constituent module of a display panel in an embodiment of the present application.

A display panel, as shown in FIG. 1, the display panel includes a display body 10 and a plurality of driving modules 20; the driving modules 20 include a driving unit 21 electrically connected to the display body 10, and the driving unit 21 is configured to provide data driving signal to the display body 10.

The driving modules can be a flip-chip thin film. At least a part of the driving modules 20 further includes a voltage conversion unit 22, and an input terminal of the voltage conversion unit 22 is electrically connected to a power source 30 to access a high-potential power supply voltage VDD; an output terminal of the voltage conversion unit 22 is electrically connected to an input terminal of the driving unit 21 to provide a preset driving voltage for the driving unit 21.

The high-potential power supply voltage VDD is provided to the driving modules 20 away from the power supply 30, and the voltage conversion unit 22 is used to convert the high-potential power supply voltage VDD input to the voltage conversion unit 22 into a preset driving voltage, so that the driving voltage of the driving unit 21 reaches a preset value. Therefore, the failure of the driving unit 21 to work normally due to the driving voltage value of the driving unit 21 being too small is prevented. At the same time, the voltage conversion unit 22 can provide a more stable driving voltage for the driving unit 21, improve the display quality, and eliminate the need to add additional buck converters and voltage stabilizers outside the driving modules 20 to save costs.

Figure 2:
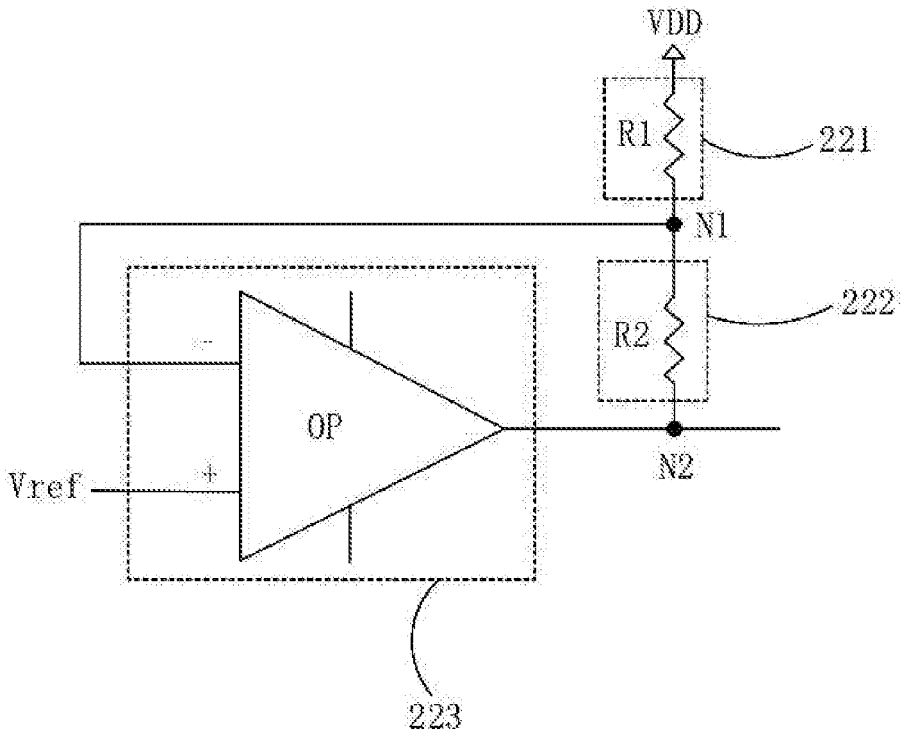
FIG. 2 is a schematic circuit structure diagram of a voltage conversion unit according to an embodiment of the present application.

Specifically, as shown in FIG. 2, the voltage conversion unit 22 includes a first voltage division unit 221, a second voltage division unit 222, and a voltage adjustment unit 223.

Wherein, a first terminal of the first voltage division unit 221 is connected to the high-potential power supply voltage VDD, and a second terminal of the first voltage division unit 221, a first terminal of the second voltage division unit 222, and a first input terminal of the voltage adjustment unit 223 are electrically connected to a first node N1.

Wherein, a second input terminal of the voltage adjustment unit 223 is connected to a reference voltage $V_{ref}$, such that a voltage value of the first node N1 reaches a voltage value of the reference voltage $V_{ref}$; and an output terminal of the voltage adjustment unit 223, an input terminal of the driving unit 21, and a second terminal of the second voltage division unit 222 are electrically connected to a second node N2, such that a voltage value of the driving voltage output by the voltage adjustment unit 223 reaches a preset value.

The voltage value of the potential of the first node N1 is adjusted to the voltage value of the reference voltage $V_{ref}$ by using the first voltage division unit 221, the second voltage division unit 222, and the voltage adjustment unit 223; thereby, a voltage value of the second node N2 reaches a preset value, that is, the voltage value of the driving voltage input to the driving unit 21 reaches a preset value.

Specifically, the first voltage division unit 221 includes a first resistor R1, a first terminal of the first resistor R1 is connected to the high-potential power supply voltage VDD, and a second terminal of the first resistor R1 is electrically connected to the first node N1.

Specifically, the second voltage division unit 222 includes a second resistor R2, a first terminal of the second resistor R2 is electrically connected to the first node N1, a second terminal of the second resistor R2 is electrically connected to the second node N2, and a resistance of the second resistor R2 is greater than a resistance of the first resistor R1.

Specifically, the voltage adjustment unit 223 includes an amplifier OP, a non-inverting input terminal of the amplifier OP is connected to the reference voltage $V_{ref}$, an inverting input terminal of the amplifier OP is electrically connected to the first node N1, and an output terminal of the amplifier OP is electrically connected to the second node N2.

It should be noted that, for those skilled in the art, the potential of the inverting input terminal of the amplifier OP is always the same as the potential of the non-inverting input terminal of the amplifier OP.

By connecting the non-inverting input terminal of the amplifier OP to the reference voltage $V_{ref}$, the voltage of the first node N1 can be adjusted so that the potential of the first node N1 is the same as the potential of the reference voltage $V_{ref}$. The reference voltage $V_{ref}$ is used as a reference voltage for the amplifier OP, the voltage value of the reference voltage $V_{ref}$ needs to be selected according to the voltage value of the power supply voltage VDD input to the voltage conversion unit 22 and the resistance ratio of the first resistor R1 and the second resistor R2. Alternatively, the resistance value ratio of the first resistor R1 and the second resistor R2 is selected by the voltage value of the power supply voltage VDD input to the voltage conversion unit 22 and the voltage value of the reference voltage $V_{ref}$. Therefore, the voltage value of the second node N2 reaches a preset value, so that the voltage value of the driving voltage input to the driving unit 21 reaches a preset value.

Taking an example of: the value of the power supply voltage VDD input to the voltage conversion unit 22 is 2.1 volts, the resistance of the second resistor R2 is twice the resistance of the first resistor R1, and the preset value of the voltage of the second node N2 is 1.8 volts. According to the formula: voltage (U)=current (I)×resistance (R), the voltage of the first node N1 is 2 volts, that is, the voltage value of the reference voltage $V_{ref}$ needs to be 2 volts.

Figure 3:
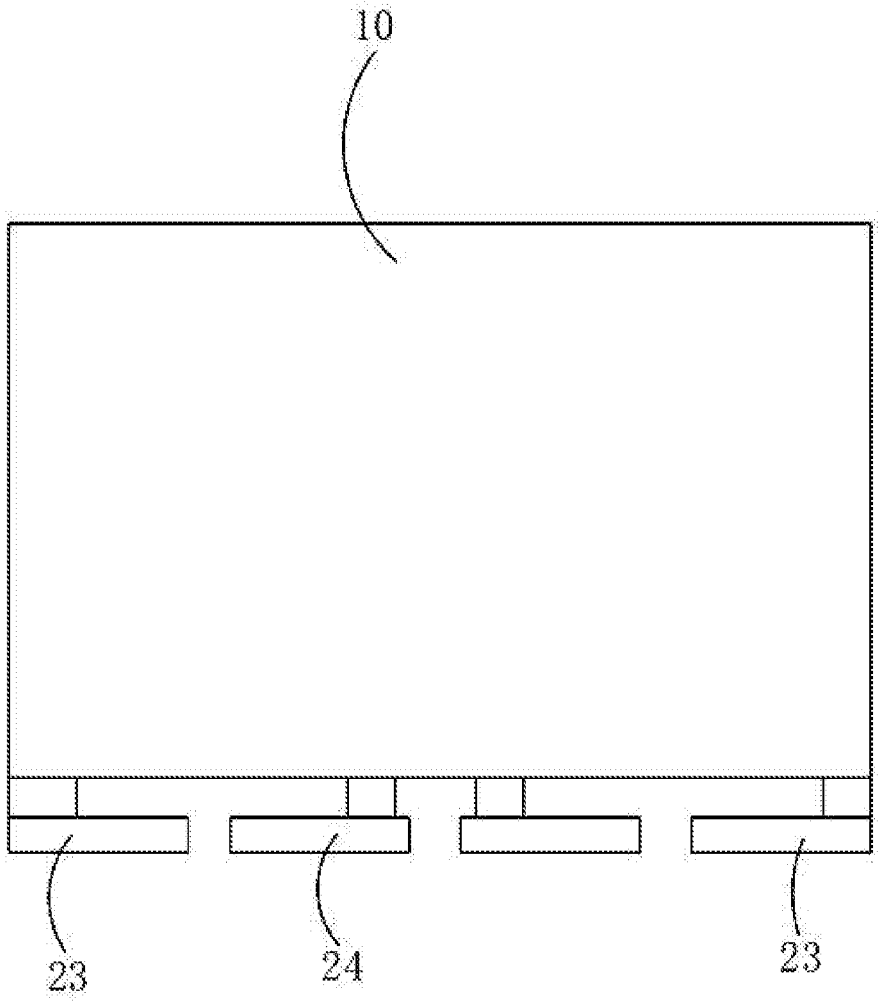
FIG. 3 is a schematic structural diagram of a display panel according to an embodiment of the present application.

In one embodiment, the resistance of the second resistor R2 is 1.5 to 3 times the resistance of the first resistor R1. It should be noted that, in actual implementation, the resistance value of the second resistor R2 can be twice the resistance value of the first resistor R1, and can be 4 times, 5 times, or more times. As shown in FIG. 3, a plurality of the driving modules 20 are positioned at a side of the display panel and are arranged at intervals along a longitudinal direction of the side of the display body 10.

In one embodiment, the driving modules 20 disposed adjacent to corners of the display body 10 each includes the voltage conversion unit 22.

It should be noted that the driving module 20 adjacent to the corner of the display body 10 is a first module 23, and the remaining driving modules 20 are second modules 24. The distance between the corners of the display body 10 and the power supply 30 is large. Due to the voltage drop of the wiring, the power supply voltage VDD input to the first module 23 will be less than the power supply voltage output from the power supply 30 to the first module 23, so that the power supply voltage output from the power supply 30 to the first module 23 will be greater than the power supply voltage output from the power supply 30 to the second module 24. Therefore, a voltage conversion unit 22 needs to be provided in the first module 23 to ensure that the voltage value of the driving voltage input to the driving unit 21 reaches a preset value.

Further, the voltage value of the power supply voltage output from the power source 30 to the first module 23 can be greater than or equal to 2 volts, and the voltage value of the high-potential power supply voltage VDD connected to the input terminal of the voltage conversion unit 22 can be greater than or equal to 1.8 volts.

In another embodiment, all the driving modules 20 include the voltage conversion unit 22.

Further, the voltage value of the power supply output by the power source 30 to the first module 23 and the second module 24 can be greater than or equal to 2 volts.

The beneficial effects of the present invention are:

A high-potential power supply voltage VDD is provided to the driving module 20 away from the power supply 30, and the voltage conversion unit 22 is used to convert the high-potential power supply voltage VDD input to the voltage conversion unit 22 into a preset driving voltage so that the driving voltage of the driving unit 21 reaches a preset value. Therefore, the failure of the driving unit 21 to work normally due to the driving voltage value of the driving unit 21 being far smaller than the preset voltage value is prevented. At the same time, the voltage conversion unit 22 can provide a more stable driving voltage for the driving unit 21, improve the display quality, and eliminate the need to add additional buck converters and voltage stabilizers outside the driving module 20 to save costs.

In the above embodiments, the description of each embodiment has its own emphasis. For a part that is not described in detail in one embodiment, reference may be made to related descriptions in other embodiments.

The description of the above exemplary embodiments is only for the purpose of understanding the invention. It is to be understood that the present invention is not limited to the disclosed exemplary embodiments. It is obvious to those skilled in the art that the above exemplary embodiments may be modified without departing from the scope and spirit of the present invention.

What is claimed is:

1. A display panel, comprising:

a display body; and a plurality of driving modules comprising a driving unit electrically connected to the display body, wherein the driving unit is configured to provide data driving signals for the display body;

wherein at least a part of the driving modules further comprises a voltage conversion unit comprising a first voltage division unit, a second voltage division unit, and a voltage adjustment unit;

wherein a first terminal of the first voltage division unit is connected to a high-potential power supply voltage, and a second terminal of the first voltage division unit, a first terminal of the second voltage division unit, and a first input terminal of the voltage adjustment unit are electrically connected to a first node;

wherein a second input terminal of the voltage adjustment unit is connected to a reference voltage, such that a voltage value of the first node reaches a voltage value of the reference voltage, and an output terminal of the voltage adjustment unit, the input terminal of the driving unit, and a second terminal of the second voltage division unit are electrically connected to a second node, such that a voltage value of the driving voltage output by the voltage adjustment unit reaches a preset value; and wherein the plurality of driving modules are positioned at a side of the display body and arranged at intervals along a longitudinal direction of the side of the display body, and a voltage value of the high-potential power supply voltage connected to the input terminal of the voltage conversion unit is greater than or equal to 1.8 volts.

2. The display panel according to claim 1, wherein the first voltage division unit comprises a first resistor, a first terminal of the first resistor is connected to the high-potential power supply voltage, and a second terminal of the first resistor is electrically connected to the first node.

3. The display panel according to claim 2, wherein the second voltage division unit comprises a second resistor, a first terminal of the second resistor is electrically connected to the first node, a second terminal of the second resistor is electrically connected to the second node, and a resistance value of the second resistor is greater than a resistance value of the first resistor.

4. The display panel according to claim 3, wherein the resistance value of the second resistor is 1.5 to 3 times the resistance value of the first resistor.

5. The display panel according to claim 3, wherein the voltage adjustment unit comprises an amplifier, a non-inverting input terminal of the amplifier is connected to the reference voltage, an inverting input terminal of the amplifier is electrically connected to the first node, and an output terminal of the amplifier is electrically connected to the second node.

6. The display panel according to claim 1, wherein each of the driving modules disposed adjacent to a corner of the display body comprises the voltage conversion unit.

7. The display panel according to claim 1, wherein each of the driving modules comprises the voltage conversion unit.

8. A display panel, comprising:

a display body; and a plurality of driving modules comprising a driving unit electrically connected to the display body, wherein the driving unit is configured to provide data driving signals for the display body;

wherein, at least a part of the driving modules further comprises a voltage conversion unit comprising a first voltage division unit, a second voltage division unit, and a voltage adjustment unit;

wherein a first terminal of the first voltage division unit is connected to a high-potential power supply voltage, and a second terminal of the first voltage division unit, a first terminal of the second voltage division unit, and a first input terminal of the voltage adjustment unit are electrically connected to a first node; and wherein a second input terminal of the voltage adjustment unit is connected to a reference voltage, such that a voltage value of the first node reaches a voltage value of the reference voltage, and an output terminal of the voltage adjustment unit, the input terminal of the driving unit, and a second terminal of the second voltage division unit are electrically connected to a second node, such that a voltage value of the driving voltage output by the voltage adjustment unit reaches a preset value.

9. The display panel according to claim 8, wherein the first voltage division unit comprises a first resistor, a first terminal of the first resistor is connected to the high-potential power supply voltage, and a second terminal of the first resistor is electrically connected to the first node.

10. The display panel according to claim 9, wherein the second voltage division unit comprises a second resistor, a first terminal of the second resistor is electrically connected to the first node, a second terminal of the second resistor is electrically connected to the second node, and a resistance value of the second resistor is greater than a resistance value of the first resistor.

11. The display panel according to claim 10, wherein the resistance value of the second resistor is 1.5 to 3 times the resistance value of the first resistor.

12. The display panel according to claim 10, wherein the voltage adjustment unit comprises an amplifier, a non-inverting input terminal of the amplifier is connected to the reference voltage, an inverting input terminal of the amplifier is electrically connected to the first node, and an output terminal of the amplifier is electrically connected to the second node.

13. The display panel according to claim 8, wherein the plurality of driving modules are positioned at a side of the display body and arranged at intervals along a longitudinal direction of the side of the display body.

14. The display panel according to claim 13, wherein each of the driving modules disposed adjacent to a corner of the display body comprises the voltage conversion unit.

15. The display panel according to claim 13, wherein each of the driving modules comprises the voltage conversion unit.

16. The display panel according to claim 8, wherein a voltage value of the high-potential power supply voltage connected to the input terminal of the voltage conversion unit is greater than or equal to 1.8 volts.

* * * * *